United States Patent [19]

Hartmannsgruber

[11] 4,375,149

[45] Mar. 1, 1983

[54] TEXTILE MACHINE SHUT-OFF DEVICE

[75] Inventor: Max Hartmannsgruber, Kirchheim, Fed. Rep. of Germany

[73] Assignee: Zinser Textilmaschinen GmbH, Ebersbach, Fed. Rep. of Germany

[21] Appl. No.: 201,956

[22] Filed: Oct. 29, 1980

[30] Foreign Application Priority Data

Nov. 14, 1979 [DE] Fed. Rep. of Germany ..... 2946031

[51] Int. Cl.[3] ..... D01H 15/00; D01H 11/00; D01H 13/16

[52] U.S. Cl. ..... 57/81; 57/78; 57/80; 57/264; 57/304

[58] Field of Search ..... 57/61, 78, 80, 81–88, 57/264, 300, 304–306

[56] References Cited

U.S. PATENT DOCUMENTS

| | | | |
|---|---|---|---|
| 2,500,343 | 3/1950 | Carrette | 57/305 X |
| 2,930,180 | 3/1960 | Adams et al. | 57/81 |
| 4,084,398 | 4/1978 | Stahlecker et al. | 57/264 X |
| 4,176,514 | 12/1979 | Stalder | 57/83 X |
| 4,206,588 | 6/1980 | Venot | 57/88 X |
| 4,242,860 | 1/1981 | Wehde et al. | 57/81 |

*Primary Examiner*—Donald Watkins
*Attorney, Agent, or Firm*—Flynn, Thiel, Boutell & Tanis

[57] ABSTRACT

A textile machine such as a spinning machine has, for each spindle, a comparator which senses the voltage at a motor driving said spindle and compares it with a reference voltage. Upon the comparator sensing such a change in the motor voltage as would be consistent with breakage of the material being worked on the machine (e.g. a roving passing towards the spindle and being spun into a thread), it operates a switch which serves both to switch off the motor driving the spindle and to arrest the material passing to the spindle.

9 Claims, 4 Drawing Figures

FIG.3
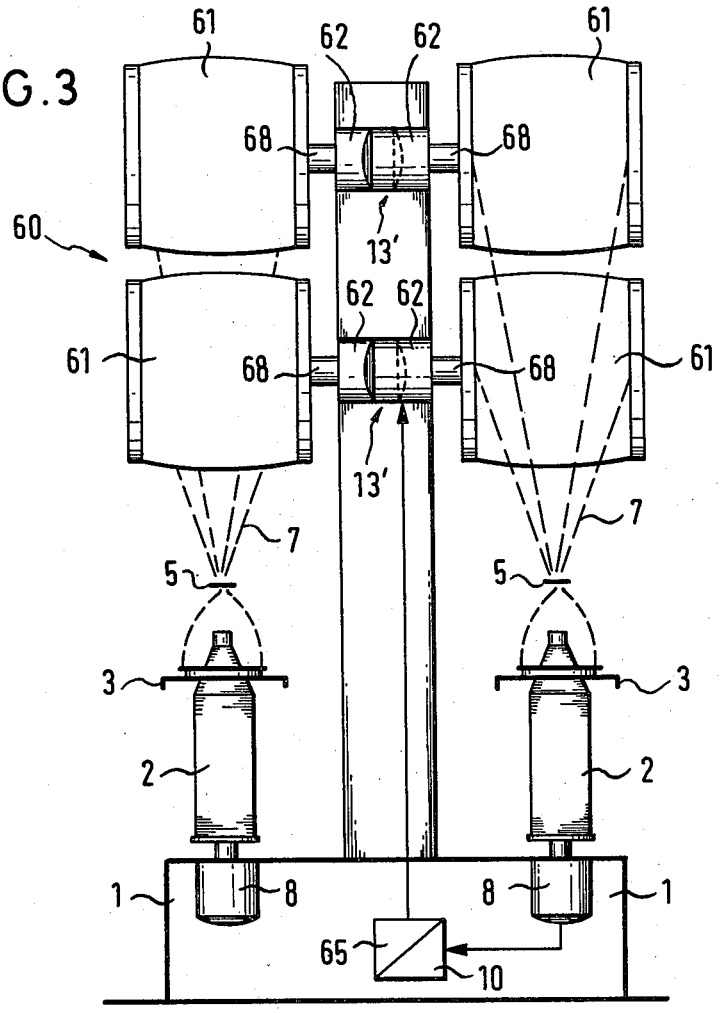
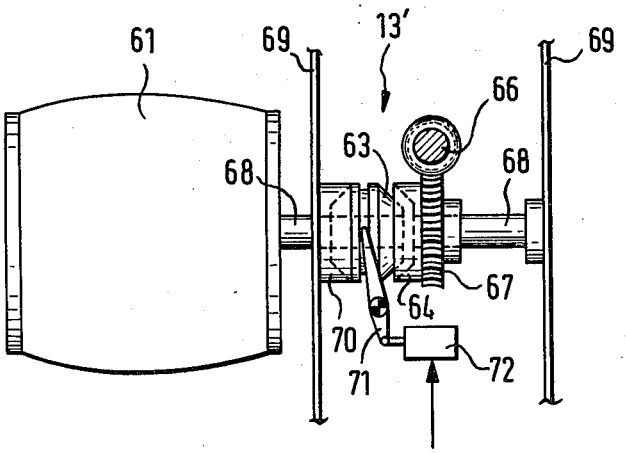
FIG.4

TEXTILE MACHINE SHUT-OFF DEVICE

BACKGROUND OF THE INVENTION

This invention concerns a textile machine shut-off device, that is to say a device for switching off an individual electric-motor spindle drive of the machine when material being worked on the machine is interrupted, and more particularly a spinning or twisting machine incorporating comparator means for sensing the interruption of the material and a switch operative thereby to switch off the machine.

In the art it is already known to provide an individual electric motor spindle drive with a comparator arrangement to compare electro-magnetic forces derived from the current drawn from the mains by the motor with an adjustable electro-magnetic counterflow as a reference, the comparator including a switch-off device to stop the motor upon interruption of the material being treated. If in the textile machine, which is, for example, a spinning or twisting machine in which thread is wound on cops, a break should occur in the thread, the comparator operates to switch off the electric motor spindle drive. Disadvantageous in this known arrangement is the fact that only stopping of the single spindle drive is achieved. The remaining components of the textile machine, associated with the spindle and its drive, can continue to run independently.

Furthermore, already known in the art, in spinning machines, are devices for halting the roving for each spindle, if the thread breaks. In one such arrangement, at the exit of a drafting roller arrangement, the thread is guided by a rolling rod which, when the thread breaks, presses a wedge into a wedge-shaped hollow space through which the roving runs so that the roving is arrested. Disadvantageous with this known arrangement is that a threadsensing device must be provided which engages the thread and hinders the free running of the thread, particularly its movement in the so-called "spinning triangle".

Also known in the art is a process for supervising the working characteristics of a twisting and spinning machine having a number of spindles working simultaneously and disposed besides each other. This arrangement serves to sense deviations from normal working, particularly thread breakage, at each individual spindle and permits statistical determination of when and in which spinning location thread breakage occurs. This device too requires a special sensor which senses and reports thread breakage or the stopping of a spindle.

In contrast hereto, an object of the present invention is to provide a device of the kind referred to in the introduction hereto which can be constructed in such a way as to provide a comprehensive evaluation of a notification once obtained of an interruption in the working of a textile machine, particularly of a spinning or twisting machine, whereby, in particular, the thread is not damaged, which is important particularly with respect to very fine or very sensitive threads.

SUMMARY OF THE INVENTION

This problem is solved in accordance with the invention in that the switch is connected to a device for interrupting the supply of material to drafting rollers or a material feed means disposed in front of the spindle. This gives the advantage that once interruption occurs in the operation of the machine, the material passing to the spindle is arrested substantially instantaneously and no damage can be caused either to the previously-open thread or to the material (e.g. roving) which is approaching the spindle.

In a development of the invention, the switch is connected to draw-off means for drawing of material moving towards the spindle, e.g. issuing from drafting rollers disposed in front of the spindle. This enables a further remedial action to occur automatically upon interruption of the operation of the spindle.

In accordance with a further preferred characteristic of the invention, the switch may be connected to an indicator device adapted to provide a visual indication when the spindle is stationary. Furthermore, it is possible to connect the switch to a data register which registers when the spindle is stationary.

In a further development of the invention, the device for drawing off threads may include an electromagnet which operates an air flap which serves to open and close a suction extractor.

In accordance with another preferred characteristic of the invention, the data register may include a counter coupled with the switch and a central evaluating unit.

In yet a further development of the invention, the textile machine is a machine without drafting rollers but is a spinning machine having driven supply bobbins supplying the roving or threads, the interrupting means for interrupting the supply of material including a device which stops the supply bobbins. This gives the advantage that even on a spinning machine on which the roving is supplied by front bobbins and thus cannot be separated from its place of supply, the occurrence of an interruption in the operation is immediately sensed and acted upon.

In another development of the invention, the interrupting means for arresting the supply of material may cut off the driving motor of the supply bobbins or may uncouple the supply bobbins from their drive means, e.g. in the form of such a driving motor, and may apply a brake to the driving motor or to the supply bobbins when uncoupled from their drive means.

Furthermore it is possible for the motors which drive the supply bobbins to be alternating current motors which are adapted to be braked with direct current. Another possibility consists in that the front supply motors, which constitute the bobbin drive, are designed as sliding-brake motors having brake shoes which, when the driving current is switched off, engage with and are pressed against a complementary braking surface.

In accordance with another possible characteristic of the invention there is the possibility of providing, as the brake, and fitted between the drive and the front bobbins, a self-retarding coupling forming part of the drive means. The brake may be in the form of a displaceable double-conical coupling.

BRIEF DESCRIPTION OF THE DRAWINGS

The invention will be described further, by way of example, with reference to the accompanying drawings, in which:

FIG. 3 is a schematic side view illustrating an embodiment of the textile machine of the invention in which the material under treatment is supplied from bobbins; and FIG. 4 is a schematic detail of the shut-off device on the spinning machine of FIG. 3.

DESCRIPTION OF THE ILLUSTRATED EMBODIMENTS

Figures 1, 2:
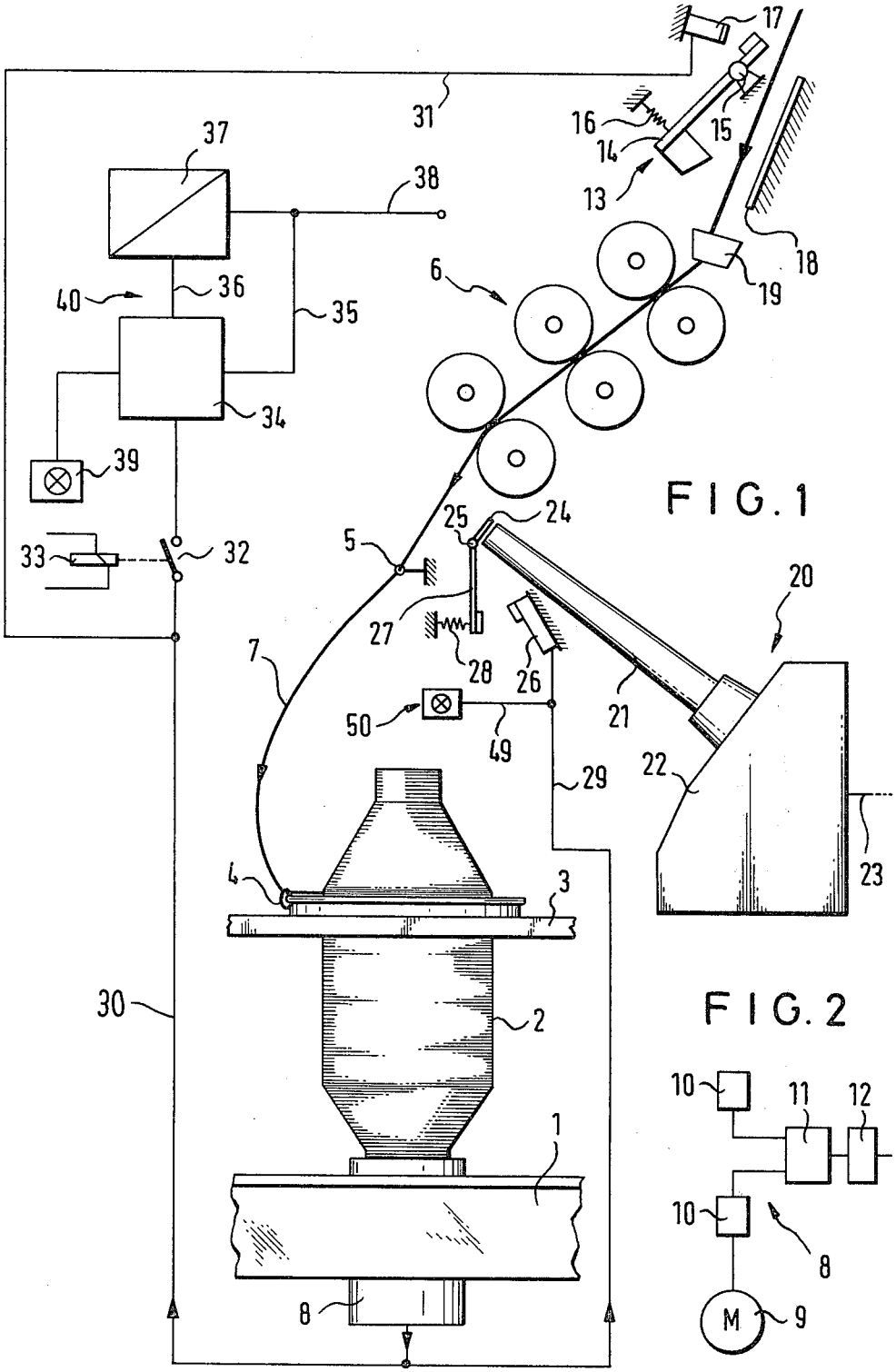
FIG. 1 is a schematic side view illustrating a preferred embodiment of the device in accordance with the invention.
FIG. 2 is an elementary block diagram illustrating a suitable arrangement for the shut-off device of the apparatus of FIG. 1.

In FIG. 1, only a single spindle for a bobbin 2 on a ring spinning machine is shown. This spindle could, however, be of a twisting machine, a tension-twisting machine, a winding and/or spinning machine or a pre-spinning machine. The spindle for the bobbin 2 is supported by a bed 1 above which is disposed a vertically movable beam 3 carrying a ring fitted with a flyer 4. Above the bobbin 2 is a thread guide 5 which serves to guide material 7 to be spun, which comes from a schematically-shown drafting arrangement 6. The material 7 extends through a secondary guide 19 into the drafting arrangement 6.

The bobbin 2 is driven by a respective electric motor single-spindle drive 8. This electric motor spindle drive 8 is shown schematically in FIG. 2 and comprises a motor 9, differential switches 10, a comparator 11 and a switch or switching off element 12. All these previously-mentioned units are provided in the single spindle drive 8 shown in FIG. 1.

Above the drafting arrangement 6 is provided an interrupting device 13 for interrupting the supply of the material 7 to the drafting arrangement 6 fitted in front of the bobbin 2. This interrupting device 13 comprises a stationary plate 18 and a clamp lever 14 which is pivotally mounted on a bearing 15. The clamp lever 14 is biassed towards its open position shown in FIG. 1 by a spring 16. The interrupting device 13, for interrupting the supply of the material 7, is associated with an electromagnet 17.

At the exit of the draft arrangement 6 is fitted a draw-off device 20 to suck away the roving or thread, which draw-off device comprises a suction extractor 21 as well as a main air duct 22. The main air duct 22 can be connected by way of a duct 23 to a filter (not shown in more detail) and a device for cleaning the filter by suction. In its front region, the suction extractor 21 has an air flap 24 which is held in place by a bearing pivot 25 on the suction extractor 21 and has a lever 27. A spring 28 holds the air flap 24 in the closed position. The lever 27 is actually connected to an electromagnet 26.

The switch 12 is furthermore connected to a data register 40 which registers when the bobbin 2 is stationary and which comprises a counter 34, a central evaluating unit 37 as well as a collecting lead 38, and a lamp 39. Furthermore a switch 32 connected to a protective solenoid 33 is provided.

The electromagnet 17 of the interrupting device 13, for interrupting the supply of the material 7, is connected by leads 30 and 31 to the electric-motor individual spindle drive 8. The electromagnet 26 of the device 20 for drawing off threads is also connected by the lead 29 to the electric-motor individual spindle drive 8. The lead 30 supplies current to the latter when the switch 32 is closed and connects the data register 40 with the electric motor individual spindle drive 8. The lead 29 is also connected by a further lead 49 to a device 50 for indicating when the bobbin 2 is stationary.

This embodiment of the invention works as follows: Each motor 9 drives a respective bobbin 2 in accordance with FIG. 2. Whilst this continues, there takes place, in the comparator 11, a continual comparison between a reference parameter, e.g. the normal motor voltages and a parameter which will vary according to whether the motor is being required to perform work on the material 7 when driving the bobbin 2, or is driving a free bobbin 2 (e.g. when the material 7 is interrupted) such as the actual motor current or voltage. If, however, the material 7 breaks, an alteration occurs in the sensed parameter of the motor, e.g. of the current or voltage, and this fact is established in the comparator 11, whereupon the switch device 12 is operated and the motor 9 is switched off. This switching-off signal is simultaneously supplied by the lead 30 to the electromagnet 31, which comes into operation and pivots the clamp lever 14 counter-clockwise against the action of the spring 16. The roving is, as a result, arrested by being clamped against a firm-standing or stationary plate 18 by the pressure of the clamp lever 40.

Furthermore, simultaneously with this shut-off of the motor 9, an indicator device 50 for indicating when the bobbin 2 is stationary is brought into operation, for example by the lighting of a lamp. Besides this, the electromagnet 26 may simultaneously be energised. This turns the lever 27 counter-clockwise against the action of the spring 28 and thus opens the air flap 24. As a result of this opening, the thread le ad at the end of the drafting arrangement is sucked away i.e. the suction extractor 21 sucks up continually any thread or roving which may be engaging from the drafting arrangement 6.

If the switch 32 is closed by the protective solenoid 33, then the counter 34 of the data register 40 is also simultaneously activated by way of the lead 30. This enables the number of thread breakages to be counted up in the counter 34.

The total thread breakages at all of the bobbins 2 can be stored in the central evaluating unit 37 by a collective lead 38 to which each counter 34 is connected by a lead 35. It is also possible that further registration of data about thread breakages can be made in the counter 34 as received from the central evaluating unit 37 by way of the lead 36. The counter 34 may also be adapted, when a certain number of thread breakages has occurred, to cause an indicator lamp 39 to light up.

The switch 32 has the function of interrupting the counting impulses which are supplied to the counter 34 when the textile machine is deliberately stopped, in order not count this stopping of the machine statistically as a thread breakage and thereby to eliminate a potential source of error.

In the arrangement of FIG. 3 the textile machine is a spinning machine does not have a drafting arrangement and is, for example, a glass-fibre spinning machine 60. Winding-up bobbins 2 are fitted on spindles supported in a bed 1, and in the upper region there is a vertically movable beam 3 of rings. Above each bobbin 2 is a respective thread guide 5 which serves to guide the material 7 coming from the front bobbins 61.

The spindles of each bobbin 2 are each driven by a respective electric motor drive 8. The electric motor drive 8 comprises a motor (not shown in detail) as well as a differential switch 10. The glass fibre spinning machine generally indicated by numeral 60 has a number of supply bobbins arranged in several rows. The front bobbins 61 are positively driven and the circumferential size thereof determines the speed of supply of the thread or roving 7. The drive can take place by electric motors 62, driving belts, or worm and worm-wheel arrangements. In each case, a plurality of supply bobbins 61 is associated with a single winding up bobbin 2 on a respective spindle. The regulating device for each spindle comprises a differential sensor 10, which senses the occurrence of a break in the thread, as well as a motor brake switch 65. This motor brake switch 65 switches off the appropriate driving motor 62 of the appropriate supply bobbin 61.

In order to stop the appropriate supply bobbin 61 quickly, for example, the front motors 62, which are normally supplied with alternating current, may have direct current applied to them.

Another possibility consists in that sliding brake shoes can be incorporated in the motor which, when the driving current is shut off, pushes its shoes against a braking surface and thus effects braking. Furthermore the possibility exists, with a mechanical development of the brake, of providing a self retarding coupling between the front bobbin motors 62 and the front bobbins 61.

In the arrangement shown in FIG. 4 a stationary brake cone 70 is fitted on one frame wall 69. On the bobbin shaft 58 is a double-cone coupling 63 fitted torsionally fast but so as to be axially displaceable, by means of a groove and key. Furthermore a driving cone 67 is fitted so as to be on the bobbin shaft 68 but so as not to be axially displaceable, and is driven by a worm-wheel 67 as well as a worm of the driving shaft 66 common to all front bobbins 61 on one level.

The double-cone coupling 63 is connected to a two-armed lever 71 which is swingable by an operating element 72. If this operating element 72 receives a signal by way of motor-brake-switch 65, it pushes the double-cone coupling 63 to the right and coupling 63 thus becomes connected to a driving cone which in its turn is connected fast to the worm-wheel 67. Thus, the supply bobbin 61 is again driven via the turnable bobbin shaft and the braking effect thereof is removed.

The arrangement of the invention ensures that only thread breakage generates a warning, and that interruption of the work is reliable sensed, whereby no damage can be caused to the running of the thread, which is a great advantage, particularly with respect to very fine or very sensitive threads.

What I claim is:

1. A textile machine, comprising a rotatably supported wind-up bobbin, a first electric motor drivingly coupled to said wind-up bobbin, a rotatably supported supply bobbin which supplies a thread to said wind-up bobbin, drive means for effecting rotation of said supply bobbin, comparator means for sensing a parameter of the electric current supplied to said first electric motor and for comparing said parameter to a reference value, switch means responsive to said comparator means and cooperable with said drive means for automatically interrupting said rotational driving of said supply bobbin by said drive means in response to a change in said sensed parameter relative to said fixed value.

2. The textile machine of claim 1, wherein said drive means include a second electric motor and coupling means drivingly coupling said second motor to said supply bobbin, and wherein said switch means interrupts the supply of electric current to said second motor in response to a change in said sensed parameter relative to said fixed value.

3. The textile machine of claim 2, wherein said machine is free of a drafting arrangement, and including a plurality of said supply bobbins, a plurality of said second motors, and a plurality of said coupling means drivingly coupling respective said second motors to respective said supply bobbins.

4. The textile machine of claim 2, including means for automatically braking said supply bobbin when said switch means interrupts the supply of electric current to said second motor.

5. The textile machine of claim 4, wherein said second motor is an AC motor and wherein said braking means includes means for supplying a DC current to said second motor.

6. The textile machine of claim 4, wherein said braking means includes a brake shoe and a braking surface provided in said second motor and means for urging said brake shoe into engagement with said braking surface when the electric current supplied to said second motor is interrupted by said switch means.

7. The textile machine of claim 4, wherein said braking means includes said coupling means having a self-retarding coupling.

8. The textile machine of claim 4, wherein said supply bobbin has a drive shaft; and wherein said braking means includes a member stationarily supported on said machine and having a first annular friction surface thereon concentric with said drive shaft, a drive element rotatably supported on and fixed against axial movement with respect to said drive shaft and having a second annular friction surface thereon concentric with said drive shaft and facing generally toward said first friction surface, said second motor being drivingly coupled to said drive element, and a coupling element supported axially movably on but fixed against rotation with respect to said drive shaft between said stationary member and said drive element, said coupling element having third and fourth annular friction surfaces on opposite sides thereof concentric with said shaft, said braking means further including actuating means for normally maintaining said coupling element in a position in which said second and fourth friction surfaces are in firm frictional engagement and for axially moving said coupling element to a position in which said first and third friction surfaces are in firm frictional engagement in response to said interruption of electric current to said second motor by said switch means.

9. The textile machine of claim 8, wherein said first, second, third and fourth friction surfaces are each substantially frusto-conical, and wherein said actuating means includes a circumferential groove provided in the periphery of said coupling element, a pivotally supported lever which has one end slidably received in said circumferential groove, and an electro-magnetic operating device actuated by a signal from said switch means and operatively coupled to said lever to effect limited pivotal movement thereof.

* * * * *

UNITED STATES PATENT AND TRADEMARK OFFICE

CERTIFICATE OF CORRECTION

PATENT NO. : 4 375 149

DATED : March 1, 1983

INVENTOR(S) : Max Hartmannsgruber

It is certified that error appears in the above-identified patent and that said Letters Patent is hereby corrected as shown below:

Col. 5, line 59; change "fixed" to ---reference---.

Col. 6, line 4; change "fixed" to ---reference---.

Signed and Sealed this

*Twenty-third* Day of *August 1983*

[SEAL]

*Attest:*

GERALD J. MOSSINGHOFF

*Attesting Officer*

*Commissioner of Patents and Trademarks*